United States Patent [19]

Mena

[11] 4,431,156

[45] Feb. 14, 1984

[54] DEVICE FOR READING IN BED

[76] Inventor: Digno Mena, 300 57th St., Apt. 14, West New York, N.J. 07093

[21] Appl. No.: 415,591

[22] Filed: Sep. 7, 1982

[51] Int. Cl.[3] ..... A47B 23/00

[52] U.S. Cl. ..... 248/445; 248/441 A

[58] Field of Search ..... 248/460, 452, 441 R, 248/441 A, 445, 448, 451, 452, 453, 459, 463

[56] References Cited

U.S. PATENT DOCUMENTS 2,908,465 10/1959 Lykes ..... 248/445
3,740,015 6/1973 Adams ..... 248/441 A
3,894,709 7/1975 Weir ..... 248/445

FOREIGN PATENT DOCUMENTS 1478012 6/1977 United Kingdom ..... 248/441 A
1525080 9/1978 United Kingdom ..... 248/441 A

*Primary Examiner*—J. Franklin Foss
*Attorney, Agent, or Firm*—Richard L. Miller

[57] ABSTRACT

A reading matter support for a reader reclining in bed, including a frame supporting an adjustably inclined, transparent panel upon which the reading material is placed for being read from therebelow.

3 Claims, 2 Drawing Figures

Fig. 1
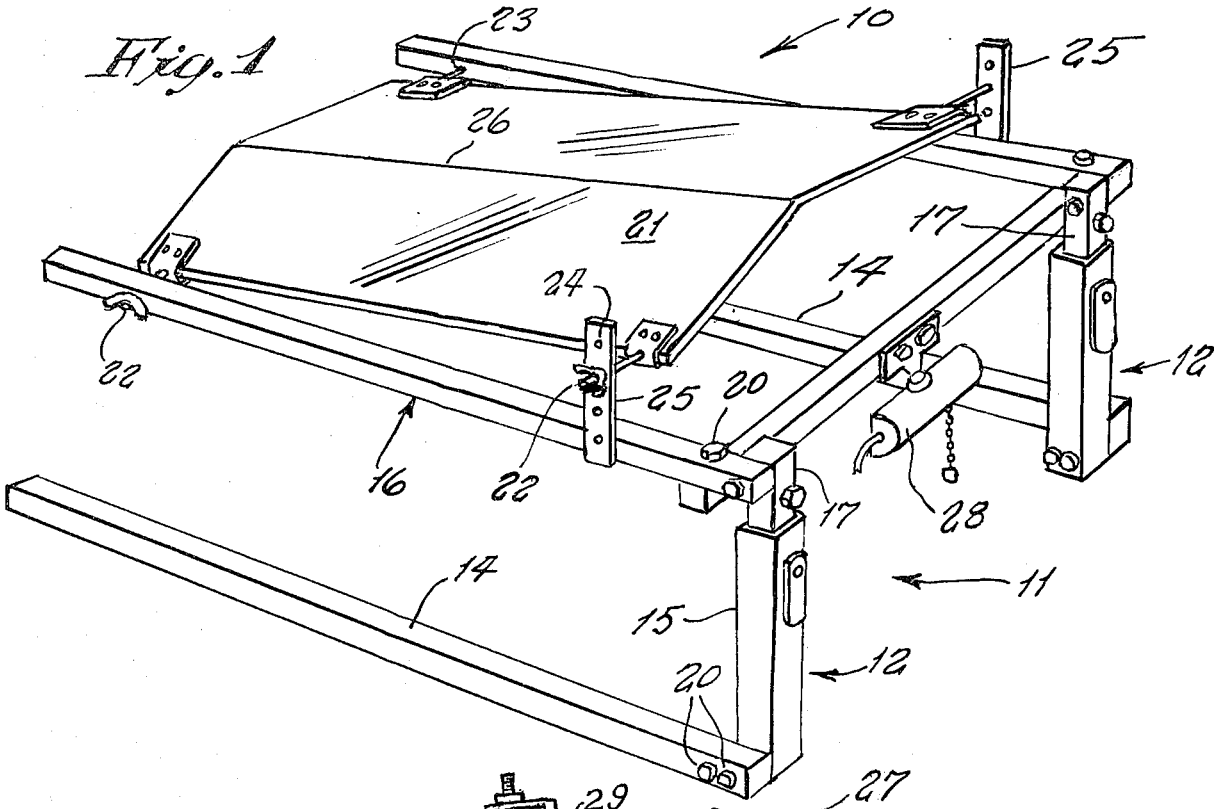
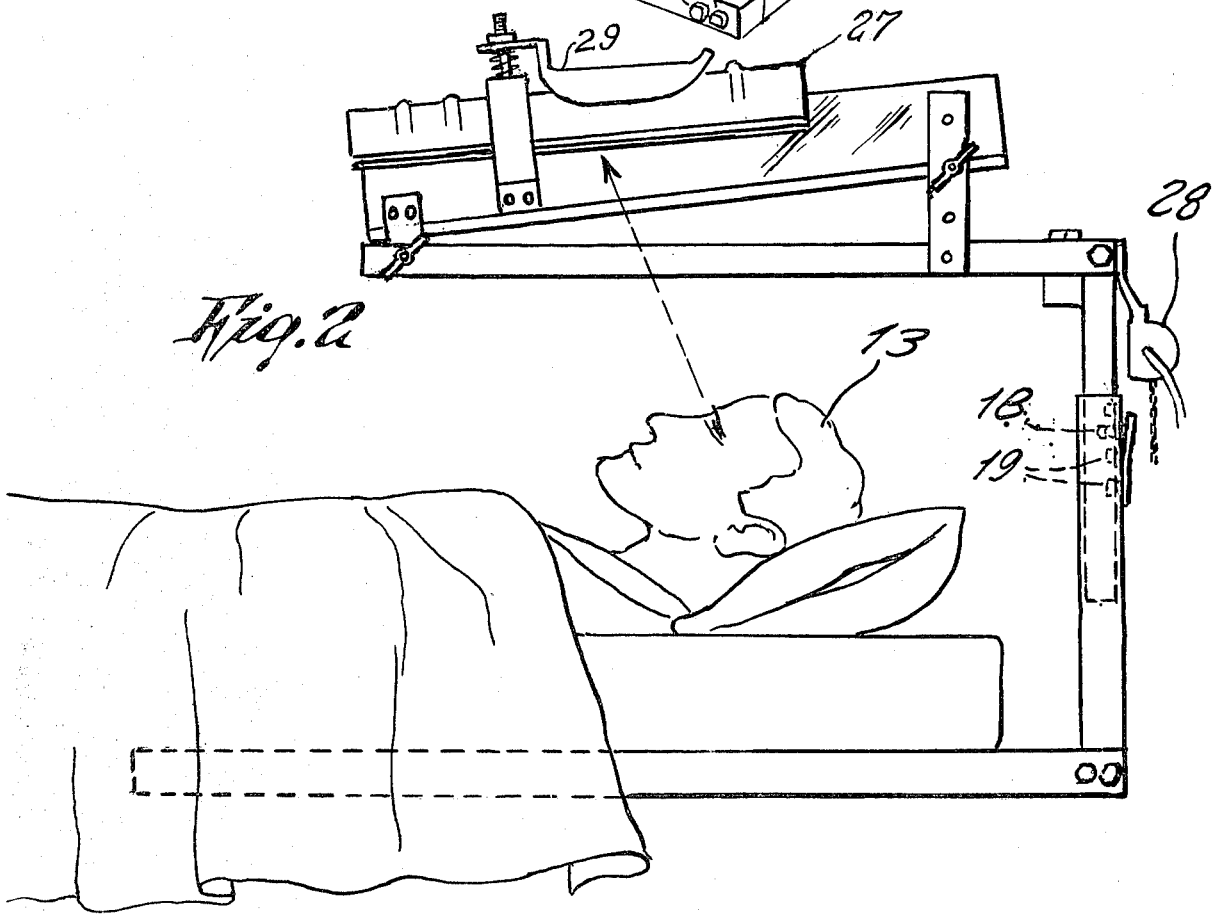
Fig. 2

DEVICE FOR READING IN BED

This invention relates generally to reading accessories. More specifically it relates to racks for supporting newspapers or books while being read.

BACKGROUND OF THE INVENTION

It is well known that many persons like to read while resting in bed. If the person sits in the bed, he can comfortably hold the book in his lap. However, if the person is laying down in a reclined position, then the reading matter must be held above him. It is very tiring for a reclining person to hold up reading matter in such position with his own hands, so that he very soon must put it down and stop the reading. This situation is accordingly in need of improvement.

SUMMARY OF THE INVENTION

Accordingly it is a principal object of the present invention to provide a rack for supporting an opened book or newspaper above a reader so that it does not have to be held up by hand.

Another object is to provide a rack which is designed particularly for use by persons while in a fully reclined position, such as in bed, so that the rack would be ideal for use by persons who like to read a while before going to sleep.

Still another object is to provide a rack which would be helpful to persons who are bed-ridden or must spend long hours laying in bed and wish to read so to pass the time as pleasantly as possible.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the invention.

FIG. 2 is a side elevation view thereof, shown in use by a person reclining in bed illustrating an additional provision for securing reading material there upon.

DETAILED DESCRIPTION OF PREFERRED EMBODIMENT

Referring now to the drawing in greater detail, the reference numeral 10 represents a rack according to the present invention, wherein there is a metal frame 11 for being rested upon a bed, the frame including a pair of bases 12 for being adjacent to each side of a person laying therebetween. Each base comprises a horizontal foot 14 affixed to an upwardly tubular leg 15. A horizontal, U-shaped frame work 16 includes a pair of downwardly vertical bars 17 which are inserted into the upper ends of the legs and are adjustably fastened therein at any selected elevation by means of a spring-supported pin 18 on each leg engaging one of a row of holes 19 along the bar.

As shown, screws 20 may be used for assembling the metal components together to form the assemblies of the two bases and the framework.

I claim:

1. A reading matter support for a reclining person therebeneath, comprising, in combination, an upper horizontal U-shaped frame having a head bar and two spaced apart arms extending therefrom, a pair of vertically adjustable posts depending from the head bar, a pair of horizontal spaced apart legs extending from the lower ends of said posts parallel to said arms, said vertical posts serving as the forward end of said reading matter support for positioning adjacent the head of the reclining person and said arms and legs extending toward the feet of the person, an inverted V-shaped transparent panel for supporting a reading matter thereon and exposing a lower side of the reading matter through said panel to the person therebeneath, a first coupling device for clamping the lower ends of said panel to the free ends of said arms, a separate coupling device for vertical adjustable coupling of the upper ends of said panel to said arms, whereby the height and tilt of said panel can be independently adjusted, and said support does not extend excessively beyond the person's head.

2. A reading matter support as in claim 1, and further comprising a support post coupled to an arm between said first and second coupling means, a spring biased clamping bar extending from said support post for clamping onto the back of the reading matter to secure it onto said panel and prevent its sliding along the panel.

3. A reading matter support as in claim 1, and further comprising lamp means mounted on said head bar to illuminate said reading matter from beneath said panel.

* * * * *